US010899998B1

(12) United States Patent
O'Lenick

(10) Patent No.: US 10,899,998 B1
(45) Date of Patent: Jan. 26, 2021

(54) MIXED POLYGLYCERYL POLYESTER QUATS

(71) Applicant: Thomas O'Lenick, Dacula, GA (US)

(72) Inventor: Thomas O'Lenick, Dacula, GA (US)

( * ) Notice: Subject to any disclaimer, the term of this patent is extended or adjusted under 35 U.S.C. 154(b) by 0 days.

(21) Appl. No.: 16/736,310

(22) Filed: Jan. 7, 2020

Related U.S. Application Data

(60) Provisional application No. 62/789,151, filed on Jan. 7, 2019.

(51) Int. Cl.
*C11C 3/02* (2006.01)

(52) U.S. Cl.
CPC ..... *C11C 3/02* (2013.01)

(58) Field of Classification Search
CPC ..... C11C 3/02
USPC ..... 554/103
See application file for complete search history.

*Primary Examiner* — Deborah D Carr

(57) ABSTRACT

The present invention is directed to a class of mixed polyglyceryl polyester quats that provide multifunctional benefit in personal care applications, including but not limited to (1) conditioning, (2) antistatic properties, (3) bacteriostatic properties and (4) exceptional mildness to skin and eyes. The products are made by the reaction reacting some on the many hydroxyl groups present on polyglycerin with (1) with fatty acids, then (2) diacids then reacted with epoxy cationic compounds to make film forming cationic polymers that are bacteriostatic and of interest in inhibiting biofilm formation on environmental surfaces.

13 Claims, No Drawings

MIXED POLYGLYCERYL POLYESTER QUATS

RELATED APPLICATIONS

This application claims priority and benefit of U.S. Provisional application No. 62/789,151 filed on Jan. 17, 2019 the disclosure of which is incorporated herein for all purposes.

GOVERNMENT SPONSORSHIP

None

FIELD OF THE INVENTION

The present invention is directed to a class of mixed polyglyceryl polyester quats that provide multifunctional benefit in personal care applications, including but not limited to (1) conditioning, (2) antistatic properties, (3) bacteriostatic properties and (4) exceptional mildness to skin and eyes.

BACKGROUND OF THE INVENTION

U.S. Pat. No. 8,986,665 to Fevola et al. teaches "a cationic polyglyceryl compounds that overcome the disadvantages of the prior art and tend to exhibit beneficial unexpected properties. In particular, applicants have discovered that the compositions and compounds of the present invention tend to exhibit improved substantively, moisture retention, foaming, viscosity building, mildness, and/or combinations thereof, as compared to other comparable (polyglycerol or otherwise) humectant compounds".

Fevola et al. teaches "According to one aspect, the present invention provides polyglyceryl compositions comprising one or more polyglyceryl compounds having: (a) a node structure comprising at least three contiguous glyceryl remnant units; (b) one or more cationic groups each linked to the node structure by an independently selected linking group; and (c) one or more hydrophobic moieties each independently (i) linked to the node structure by a linking group, or (ii) constituting a portion of one of the one or more cationic groups".

Fevola continues "As noted above, applicants have discovered that certain cationic polyglyceryl compositions can be used as non-ethoxylated, substantive humectants in various compositions, including cosmetic and personal care compositions. The resulting compositions may be suitable for use as cleansing, rinse-off, or leave-on compositions.

While interesting in providing humectancy, the compounds of U.S. Pat. No. 8,986,665 are not conditioners, self-preserving systems, antistats. The presence of the crosslinking diacid is required to obtain the performance of the polymers of the current invention. This ability to make the products of the current invention requires a two-step reaction and cannot be made with the teachings of '665. In fact the claims of '665 indicate the multi-functional properties will be lacking in the claims by claims two "A personal care composition comprising: a solvent, a polyglyceryl composition, comprising N-(2-hydroxypropyl)-N,N-dimethyllauryl-1-ammonium chloride decaglyceryl ether, and at least one material selected from the group consisting of surfactants, chelating agents, emollients, humectants, conditioners, preservatives, opacifiers, fragrances, and combinations of two or more thereof, wherein the personal care composition comprises less than 5 percent by weight of an electrolyte, and wherein the polyglyceryl composition has an average degree of polymerization determined by hydroxyl value testing (DPOH) of from about 3 to about 20".

U.S. Pat. No. 7,507,399 to O'Lenick, likewise is made in one step and does not include an ester group needed for functionality.

It is not until the two step processes of the present invention allowed for the preparation of polymers of the present invention was it possible to make such polymers.

OBJECT OF THE INVENTION

It is the object to provide a group of polyglyceryl esters linked together by a di-acid then in subsequent reaction reacted with an alkyl quat intermediate having the following structure;

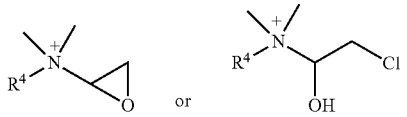

wherein:

$R^4$ is alkyl containing 1 to 18 carbons; and mixtures thereof.

The crosslinking of the polymers of the present invention with a diacid contributes significant barrier properties that render the hair and skin conditioned, smooth, and having a dry aesthetic.

An additional aspect of the present invention is to provide an additive to shampoos, body washes, and conditioners providing highly desirable properties, including outstanding mildness.

Finally, it is the object of the invention to provide materials that are bacteriostatic. That is, formulations using the compounds of the present invention are resistant to bacterial challenges.

DESCRIPTION OF THE INVENTION

Summary of the Invention

The current invention combines two very different sequential reaction steps that require different processes and process conditions to produce a heretofore unknown polymer having highly desirable properties. Firstly, in the polyglycerin is crosslinked with a diacid. This process called esterification is carried out at high temperature without a solvent. Water is the by product and is efficiently stripped off. This provides a polymeric material that has both hydrophilic (polyglycerin) and hydrophobic (fatty diacid) moieties. It is the balance of these moieties that allows for the creation of products with differing solubilities and HLB values. Secondly, in a the intermediate of step one is reacted with and alkyl quat intermediate in water to produce the desired cationic polymers. The alkyl quat intermediate has the following structure;

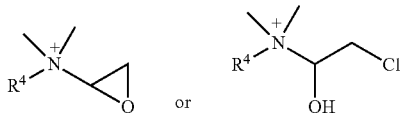

Wherein:

$R^4$ is alkyl containing 1 to 18 carbons; and mixtures thereof.

DETAILED DESCRIPTION OF THE INVENTION

One aspect of the present invention is directed towards a polyglycerol quat made by the reaction of:

1. A polyglycerol quat prepared by the sequential reaction of:

A. a prepolymer made by the reaction of:

a. polyglycerin b. an alkyl group having the following structure:

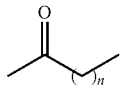

wherein:

n is an integer ranging from 6 to 24;

c. a cross-linking alkyl having the following structure:

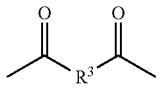

wherein;

$R^3$ is independently selected from the groups consisting of:

a. an alkyl ranging from 2 to 16 carbons;

b. hydrogenated dimer acid c. dimer acid and mixtures thereof;

B. an alkyl quat intermediate having the following structure:

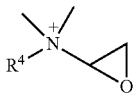

or

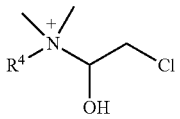

wherein $R^4$ is alkyl containing 1 to 18 carbons;

and mixtures thereof.

Preferred Embodiments

In a preferred embodiment n is 6.

In a preferred embodiment n is 8.

In a preferred embodiment n is 10.

In a preferred embodiment n is 12.

In a preferred embodiment n is 14.

In a preferred embodiment n is 16.

In a preferred embodiment n is 18.

In a preferred embodiment n is 20.

In a preferred embodiment n is 22.

In a preferred embodiment n is 32.

Examples

Raw Materials

Polyglycerol

Polyglycerol are commercially available from a variety of sources including Solvay, of Alpharetta, Ga. It has the following structure:

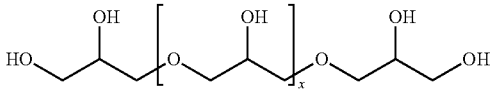

| Example | X | Polyglycerol | Molecular Weight |
|---|---|---|---|
| 1 | 1 | Polyglycerol-3 | 240 |
| 2 | 2 | Polyglycerol-4 | 314 |
| 3 | 4 | Polyglycerol-6 | 462 |
| 4 | 6 | Polyglycerol-8 | 610 |
| 5 | 8 | Polyglycerol-10 | 758 |

Fatty Acids

Fatty acids useful in the practice of the present invention are items of commerce commercially available from Cognis.

Fatty Acid Names

Fatty acids useful as raw materials in the preparation of compounds of the present invention are commercially available from a variety of sources including Procter and Gamble of Cincinnati Ohio. The structures are well known to those skilled in the art.

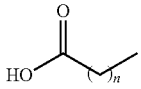

| | N | Common Name | Molecular Weight |
|---|---|---|---|
| Example | | | |
| 6 | 6 | Caprylic | 144 |
| 7 | 8 | Capric | 172 |
| 8 | 10 | Lauric | 200 |
| 9 | 12 | Myristic | 228 |
| 10 | 13 | Pentadecanoic | 242 |
| 11 | 14 | Palmitic | 256 |
| 12 | 16 | Stearic | 284 |
| 13 | 16 | Isosteric | 284 |
| 14 | 18 | Arachidinic | 312 |
| 15 | 20 | Behenic | 340 |
| 16 | 15 | cetrotic | 396 |
| 17 | 32 | geddic acid | 508 |
| Unsaturated Example | | | |
| 18 | 16 | Oleic | 282 |
| 19 | 16 | Linoleic | 280 |
| 20 | 16 | Linolenic | 278 |
| 21 | 14 | Palmitoleic | 254 |
| 22 | 12 | Myristicoleic | 226 |
| 23 | 20 | Erucic | 338 |

Dicarboxylic Acids

Dicarboxylic acids are useful raw materials in the synthesis of the compounds of the present invention and are commercially available from a variety of sources including Cognis. They have the following structure:

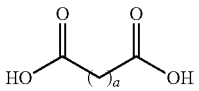

Saturated Dicarboxylic Acids

| Example | Common Name | a | Molecular Weight |
|---|---|---|---|
| 24 | Malonic | 1 | 104 |
| 25 | Succinic | 2 | 118 |
| 26 | Glutaric | 3 | 132 |
| 27 | Adipic | 4 | 146 |
| 28 | Pimelic | 5 | 160 |
| 29 | Subric | 6 | 174 |
| 30 | Azelaic | 7 | 188 |
| 31 | Sebacic | 8 | 202 |
| 32 | Undecanedioic | 9 | 216 |
| 33 | Dodecanedioic | 10 | 230 |

Example 34 Dimer Acid

Dimer acid is an item of commerce available commercially from Cognis Corporation. It conforms to the following structure:

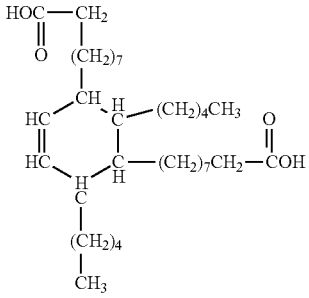

Example 35 Hydrogenated Dimer Acid

Hydrogenated dimer acid is an item of commerce available commercially from Henkel Corporation. It conforms to the following structure:

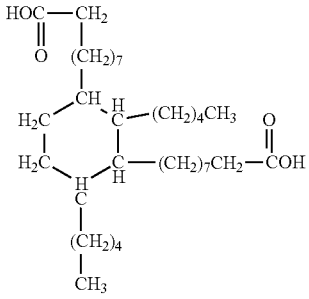

Quat Intermediates

Quat Intermediates are items of commerce available commercially from Colonial Chemical South Pittsburgh Tn. They conform to the following structure:

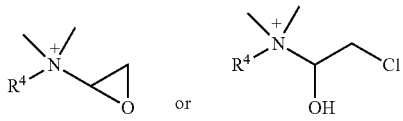

| Example | $R^4$ | MW |
|---|---|---|
| 36 | —$CH_3$ | 158 |
| 37 | Lauryl | 358 |
| 38 | Coco | 426 |

Polyglycerol Prepolymer (Step 1)

General Procedure

To a flask equipped with thermometer, heat and distillation ability is added the specified number of grams of polyglycerol (examples 1-5) and the specified number of grams of the specified a fatty acid (examples 6-23). The mixture is heated to 160-200° C. under agitation. The temperature is held in this range for 8-10 hours as water distills off. The resulting product is cooled and used without additional purification.

| | Polyglycerol | | Fatty acid | | |
|---|---|---|---|---|---|
| Example | Example | Grams | Example | Grams | Unreacted-OH |
| 39 | 1 | 53.57 | 6 | 96.43 | 2 |
| 40 | 3 | 46.39 | 7 | 103.61 | 2 |
| 41 | 3 | 60.26 | 7 | 89.74 | 4 |
| 42 | 5 | 31.60 | 12 | 118.40 | 2 |
| 43 | 5 | 46.18 | 12 | 103.82 | 6 |
| 44 | 1 | 32.92 | 13 | 117.08 | 2 |
| 45 | 3 | 46.39 | 15 | 103.61 | 2 |
| 46 | 3 | 60.36 | 15 | 89.74 | 4 |
| 47 | 5 | 27.45 | 18 | 122.55 | 2 |
| 48 | 5 | 27.45 | 18 | 103.59 | 6 |
| 49 | 1 | 33.52 | 20 | 116.48 | 2 |

| | Polyglycerol | | Fatty acid | | Fatty Acid | | |
|---|---|---|---|---|---|---|---|
| Example | Example | Grams | Example | Grams | Example | Grams | Unreacted-OH |
| 50 | 1 | 41.24 | 6 | 37.11 | 20 | 71.65 | 2 |
| 51 | 3 | 37.99 | 7 | 42.43 | 18 | 69.57 | 2 |
| 52 | 3 | 50.58 | 7 | 37.66 | 18 | 61.75 | 4 |
| 53 | 5 | 32.54 | 12 | 73.15 | 15 | 44.30 | 2 |
| 54 | 5 | 53.48 | 12 | 60.11 | 15 | 36.41 | 6 |
| 55 | 1 | 32.92 | 13 | 58.54 | 12 | 58.54 | 2 |
| 56 | 3 | 49.15 | 15 | 54.89 | 6 | 45.96 | 2 |
| 57 | 3 | 63.35 | 15 | 47.17 | 6 | 39.49 | 4 |
| 58 | 5 | 37.55 | 18 | 69.85 | 7 | 42.60 | 2 |
| 59 | 5 | 53.63 | 18 | 59.86 | 7 | 36.51 | 6 |
| 60 | 1 | 33.22 | 20 | 57.72 | 12 | 59.07 | 2 |
| 61 | 3 | 31.05 | 12 | 50.02 | 13 | 50.02 | 2 |
| 62 | 3 | 43.31 | 12 | 53.34 | 13 | 53.34 | 4 |
| 63 | 5 | 31.56 | 12 | 59.22 | 13 | 59.22 | 2 |
| 64 | 5 | 46.13 | 12 | 51.94 | 13 | 51.94 | 6 |

General Procedure Dimer Prepolymers

To a flask equipped with thermometer, heat and distillation ability is added the specified number of grams of polyglycerol (examples 1-5), di-acid (examples 24-35) and the specified number of grams of the specified a fatty acid (examples 6-23). The mixture is heated to 160-200° C. under agitation. The temperature is held in this range for 8-10 hours as water distills off. The resulting product is cooled and used without additional purification.

| | Polyglycerol | | Fatty acid | | Fatty Acid | | Di-Acid | | |
|---|---|---|---|---|---|---|---|---|---|
| Example | Example | Grams | Example | Grams | Example | Grams | Example | Grams | Unreacted-OH |
| 65 | 5 | 29.17 | 12 | 109.27 | — | — | 35 | 11.56 | 2 |
| 66 | 5 | 45.87 | 12 | 85.94 | — | — | 35 | 18.19 | 10 |
| 67 | 1 | 25.85 | 13 | 91.78 | — | — | 35 | 32.37 | 2 |
| 68 | 1 | 32.48 | 13 | 76.86 | — | — | 35 | 40.66 | 4 |
| 69 | 1 | 25.82 | 12 | 45.92 | 13 | 45.92 | 35 | 32.34 | 2 |
| 70 | 1 | 32.45 | 12 | 38.46 | 13 | 38.46 | 35 | 40.63 | 4 |
| 71 | 3 | 60.05 | 6 | 28.08 | 20 | 54.20 | 25 | 7.67 | 2 |
| 72 | 3 | 72.41 | 6 | 22.57 | 20 | 43.57 | 27 | 11.44 | 4 |
| 73 | 5 | 28.61 | 12 | 53.69 | 15 | 64.16 | 30 | 3.55 | 2 |
| 74 | 5 | 47.11 | 12 | 44.21 | 15 | 52.82 | 33 | 5.84 | 10 |
| 75 | 3 | 49.71 | 18 | 23.24 | 7 | 44.87 | 34 | 32.17 | 2 |
| 76 | 3 | 58.58 | 18 | 18.26 | 7 | 35.25 | 34 | 37.91 | 4 |
| 77 | 3 | 42.88 | 12 | 39.61 | 13 | 39.61 | 35 | 27.89 | 2 |
| 78 | 3 | 32.45 | 12 | 38.46 | 13 | 38.46 | 35 | 40.63 | 4 |
| 79 | 5 | 29.13 | 12 | 54.66 | 13 | 54.66 | 35 | 11.55 | 2 |
| 80 | 5 | 69.86 | 12 | 26.22 | 14 | 26.22 | 35 | 27.70 | 10 |

Alkyl Quat Intermediate (Step 2)

General Procedure

An alkyl quat intermediate (examples 37 or 38) is added into a round bottom flask. Sodium hydroxide solution is added to adjust the pH. Water is added to adjust to 15% wt. Polyglycerol prepolymer (examples 39-80) is added into the round bottom and stirred. The round bottom flask is placed under reflux and heated to 85-95° C. Once the reaction clears, example 36 is added and allowed to react for 4-6 hours.

| | Polyglycerol Prepolymer | | Example 36 | Example 37 | Example 38 |
|---|---|---|---|---|---|
| Example | Example | Grams | Grams | Grams | Grams |
| 81 | 39 | 72.62 | — | 77.38 | — |
| 82 | 41 | 74.42 | 20.45 | — | 55.13 |
| 83 | 42 | 131.19 | 5.76 | 13.05 | — |

-continued

| | Polyglycerol Prepolymer | | Example 36 | Example 37 | Example 38 |
|---|---|---|---|---|---|
| Example | Example | Grams | Grams | Grams | Grams |
| 84 | 43 | 84.97 | 10.91 | 24.71 | 29.41 |
| 85 | 45 | 98.38 | — | 23.57 | 28.05 |

-continued

| | Polyglycerol Prepolymer | | Example 36 | Example 37 | Example 38 |
|---|---|---|---|---|---|
| Example | Example | Grams | Grams | Grams | Grams |
| 86 | 52 | 80.97 | 18.68 | — | 50.35 |
| 87 | 55 | 101.91 | 14.73 | 33.36 | — |
| 88 | 57 | 77.19 | 22.30 | 50.52 | — |
| 89 | 62 | 75.76 | — | 33.90 | 40.34 |
| 90 | 64 | 85.02 | 10.90 | 24.70 | 29.39 |
| 91 | 69 | 126.57 | 7.17 | 16.25 | — |
| 92 | 70 | 102.57 | 14.58 | 33.04 | — |
| 93 | 73 | 139.73 | 2.78 | — | 7.49 |
| 94 | 74 | 87.45 | 5.73 | 25.95 | 30.88 |
| 95 | 77 | 120.72 | — | 13.37 | 15.91 |
| 96 | 78 | 87.89 | — | 28.36 | 33.75 |
| 97 | 79 | 140.70 | 2.85 | 6.45 | — |
| 98 | 90 | 72.80 | 7.07 | 32.03 | 38.11 |

Unexpectantly, the presence of the two different substitution patterns in the quaternary compounds of the current invention, one having $R^4$ defined as methyl and other in which $R^4$ is defined as higher alkyl provides for materials where the former group (methyl) is water soluble and bacteriostatic and the latter higher alkyl is surface active, foaming and conditioning. The compounds of this type of structure are very effective in the treatment of non-woven sheets to allow for the wetting of the hydrophobic sheets by water, generally used for baby wipes. The presence of the higher alkyl groups provides mild conditioning, foam and cleansing. The ratio between the two groups allows for the ability to fine tune the desired properties, matching it to the hydrophobicity of the non-woven sheet. Finally, unlike amino silicones that are also used in the preparation of non-woven sheets, these products are biodegradable and do not release methanol during storage when the methoxy group present in such silicones reacts with water.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth hereinabove but rather that the claims be construed as encompassing all the features of patentable novelty which reside in the present invention, including all features which would be treated as equivalents thereof by those skilled in the art to which the invention pertains.

What is claimed is:

1. A polyglycerol quat prepared by the sequential reaction of:

A. a prepolymer made by the reaction of:

a. polyglycerin;

b. an alkyl group having the following structure:

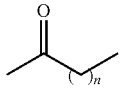

wherein:

n is an integer ranging from 6 to 24;

c. a cross-linking alkyl having the following structure:

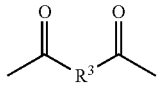

wherein;

$R^3$ is independently selected from the groups consisting of:

a. an alkyl ranging from 2 to 16 carbons;

b. hydrogenated dimer acid c. dimer acid and mixtures thereof;

B. an alkyl quat intermediate having the following structure:

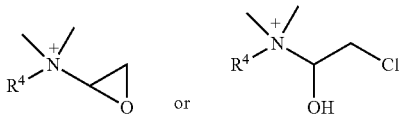

wherein:

$R^4$ is alkyl containing 1 to 18 carbons;

and mixtures thereof.

2. The polyglycerol of claim 1 wherein n is 6.

3. The polyglycerol of claim 1 wherein n is 8.

4. The polyglycerol of claim 1 wherein n is 10.

5. The polyglycerol of claim 1 wherein n is 12.

6. The polyglycerol of claim 1 wherein n is 14.

7. The polyglycerol of claim 1 wherein n is 16.

8. The polyglycerol of claim 1 wherein n is 18.

9. The polyglycerol of claim 1 wherein n is 20.

10. The polyglycerol of claim 1 wherein n is 22.

11. The polyglycerol of claim 1 wherein n is 18.

12. The polyglycerol of claim 1 wherein n is a mixture of 6 and 20.

13. The polyglycerol of claim 1 wherein n is a mixture of 10 and 22.

* * * * *